US009509071B2

(12) United States Patent
Filipon et al.

(10) Patent No.: US 9,509,071 B2
(45) Date of Patent: Nov. 29, 2016

(54) SEALED CIRCUIT BOARD PLUG CONNECTOR

(71) Applicant: Amphenol Tuchel Electronics GmbH, Heilbronn (DE)

(72) Inventors: Sven Filipon, Heilbronn (DE); Danica Holley, Neuenstadt (DE); Michael Knodler, Stuttgart (DE)

(73) Assignee: Amphenol-Tuchel Electronics GMBH (DE)

( * ) Notice: Subject to any disclaimer, the term of this patent is extended or adjusted under 35 U.S.C. 154(b) by 0 days.

(21) Appl. No.: 14/758,975

(22) PCT Filed: Dec. 7, 2013

(86) PCT No.: PCT/EP2013/003697
§ 371 (c)(1),
(2) Date: Jul. 2, 2015

(87) PCT Pub. No.: WO2014/124657
PCT Pub. Date: Aug. 21, 2014

(65) Prior Publication Data

US 2015/0357747 A1 Dec. 10, 2015

(30) Foreign Application Priority Data

Feb. 16, 2013 (DE) ..... 10 2013 002 709

(51) Int. Cl.
*H01R 13/73* (2006.01)
*H01R 12/58* (2011.01)
*H01R 12/71* (2011.01)
(Continued)

(52) U.S. Cl.
CPC ..... *H01R 12/585* (2013.01); *H01R 12/7064* (2013.01); *H01R 12/716* (2013.01); *H01R 13/5202* (2013.01)

(58) Field of Classification Search
CPC ..... H01R 13/5202; H01R 13/5219; H01R 13/6584
USPC ..... 439/559, 274, 78, 83
See application file for complete search history.

(56) References Cited

U.S. PATENT DOCUMENTS 4,645,278 A * 2/1987 Yevak, Jr. ..... H01R 13/447 228/212
5,015,192 A * 5/1991 Welsh ..... H01R 12/716 29/843

(Continued)

FOREIGN PATENT DOCUMENTS

DE 20 2012 002 975 U1 4/2012
DE 10 2011 051 644 A1 1/2013

OTHER PUBLICATIONS

International Search Report issued in PCT/EP2013/003697 on Apr. 4, 2014.

*Primary Examiner* — Phuong Dinh
(74) *Attorney, Agent, or Firm* — Blank Rome LLP

(57) ABSTRACT

A sealed circuit board connector for electrically connecting a connector to a circuit board. The connector includes an interface housing which has at least one signal contact in the connection region and which has at least two press-in elements with press-in zones. The interface housing is designed with a contact area for a seal. The seal is arranged in the sealing region of the circuit board plug. The seal has a passage opening for the at least one signal contact or contacts and has in each case one opening for the at least two press-in elements.

9 Claims, 3 Drawing Sheets

(51) Int. Cl.
*H01R 12/70* (2011.01)
*H01R 13/52* (2006.01)

(56) References Cited

U.S. PATENT DOCUMENTS 5,059,130 A * 10/1991 Miller, Jr. ..... H01R 12/523 439/74
5,344,341 A * 9/1994 Yoshino ..... H01R 23/688 439/607.03
8,408,923 B2 * 4/2013 Tay ..... H01R 12/58 439/79
2001/0000368 A1 * 4/2001 Ward ..... H01R 43/16 29/874
2005/0118864 A1 6/2005 Watanabe et al.
2006/0148280 A1 7/2006 Ashman et al.
2011/0034073 A1 2/2011 Umfahrer et al.

* cited by examiner

SEALED CIRCUIT BOARD PLUG CONNECTOR

RELATED APPLICATIONS

This application is the national stage of International Patent Application No. PCT/EP2013/003697, filed Dec. 7, 2013, which claims the benefit of German Patent No. 102013002709.8, filed Feb. 16, 2013, which is hereby incorporated by reference in its entirety.

FIELD OF THE INVENTION

The present invention relates to an electrical plug connector as claimed in patent claim 1.

The present invention therefore relates, in particular, to an electrical plug connector for connection to a circuit board and for connecting a plug to the plug connector.

BACKGROUND OF THE INVENTION

Circuit board plug connector solutions of the generic type, in particular for currents of up to 10 A for different electronics applications, in particular for applications in which high temperatures, such as temperatures of up to 180°, and also environmental influences such as moisture occur, cause the technical problems cited in the text which follows.

There are a variety of contact-making technologies for connecting circuit board plug connections to the circuit board.

One conventional way is connection using solder contacts. However, a solder gas is produced during soldering, and this can lead to undesired side effects and also to excess pressure in the solder region.

Solder vapors are released during soldering, and these solder vapors can lead either directly to excess pressure in a sealed region or to damage to the circuit board plug connector or to the circuit board.

Furthermore, many circuit board applications are subject to the RoHS guideline in which only certain solders, and in particular lead-free solders, may be used.

This leads to the formation of whiskers and other undesired side effects and is likewise to be avoided.

In the case of a sealed circuit board interface, both the leaktightness of said circuit board interface and also a compact design should be ensured and a secure connection to the circuit board can be provided.

Furthermore, permanent sealing should be ensured and mechanically stable connection of the electrical contacts should be ensured.

SUMMARY OF THE INVENTION

The object of the present invention is therefore to provide a circuit board plug connector which on the one hand is connected to the circuit board in a mechanically stable manner and on the other hand is sufficiently well sealed off from the environment with respect to the ingress of water and liquids.

A plug connector is sealed within the meaning of the present invention if it is intended to be designed to meet protection class IP55, which is provided in accordance with the international IP degree of protection, or better.

The present object is achieved by the features of patent claim 1.

Advantageous developments of the invention are specified in the dependent claims.

All combinations of at least two of the features specified in the description, the claims and/or the drawings are also covered within the scope of the invention.

When value ranges are indicated, values which lie within said limits should also count as being disclosed as limit values and be able to be claimed in any desired combination.

The same reference symbols are used for identical components in the description of the figures.

The basic idea of the present invention is to design a circuit board plug connector with a sealing element or a seal and also with press-in contacts for mechanically, but not electrically, connecting the circuit board plug connector to a circuit board, wherein the seal is arranged in a sealing region and the press-in contacts project through passage openings in the seal.

In this way, the circuit board plug connector can be pressed into the circuit board by means of mechanical press-in contacts in order to establish a mechanical connection with the circuit board, while the signal contacts can pass through the circuit board, wherein, at the same time, the seal as stated above closes the passage openings and therefore a sealed interface can be produced.

Therefore, the invention provides a sealed circuit board plug connector for electrically connecting a plug to a circuit board, said sealed circuit board plug connector comprising an interface housing which has at least one signal contact in the connection region and which has at least two press-in elements with press-in zones, wherein the interface housing is designed with a contact area for a seal and a seal is arranged in the sealing region of the circuit board plug connector, wherein the seal has a passage opening for the signal contact or contacts and has in each case one opening for the press-in elements.

By virtue of a refinement according to the invention of this kind, the press-in elements can be mechanically connected fixedly to the circuit board by way of their press-in zones, specifically in such a way that a mechanically stable arrangement, which is clearly defined in the sealing plane, of the circuit board plug connector to the circuit board is ensured.

In a preferred embodiment, the signal contacts are in the form of press-in contacts. Owing to the design of the signal contacts as press-in contacts, further manufacturing steps can be avoided to the effect that soldering processes or other connecting processes can be avoided.

In this respect, the press-in contacts can make electrical contact with conductor tracks of the circuit board, while the press-in elements establish the mechanical connection to the circuit board.

In particular, the press-in elements can be produced from a first material, while the signal contacts can be produced from a second material which is different from the first material.

In this respect, the material of the press-in elements can be selected such that a mechanical connection which is as optimal as possible is established with a corresponding opening in the circuit board, while the signal contacts are provided from a material which is optimal for power transmission and electrical connection.

In a preferred embodiment, the circuit board plug connector is designed with a socket body with a receiving space for receiving a corresponding mating plug on that side of the circuit board plug connector which is situated opposite the contact area, and wherein the signal contacts project into the receiving space by way of one of their ends.

An integral socket body can be provided in this way, said socket body firstly having the press-in elements and secondly comprising signal contacts which extend from the receiving space into the connection space.

In a further advantageous embodiment, the signal contacts have press-in zones and the press-in zones of the signal contacts lie in the same mounting plane as the press-in zones of the press-in elements.

Owing to this particularly advantageous refinement, it is possible to ensure that, when the circuit board plug connector is pressed against the circuit board, the press-in depth is set to a fixed, defined extent, and, when the circuit board plug connector is fully inserted into the corresponding press-in openings in the circuit board, a defined mounting plane is set, as a result of which firstly manufacturing reliability is produced and secondly compression can be performed to a predetermined defined extent by suitable selection of the seal.

The circuit board plug connector according to the invention is preferably designed such that the seal is arranged at least partially in the region of the press-in zones in the thickness direction, and therefore the seal is compressed in the thickness direction when the circuit board plug connector is pressed into a circuit board. This means that a seal which can be compressed in the thickness direction is preferably used.

It is further advantageous when the sealing region is designed with a recess for inserting the seal into the recess.

It is further advantageous when the recess is completely bounded by a collar which surrounds the signal contacts and the press-in elements.

This has the advantage that, owing to the recess, firstly the position of the sealing is ensured and, when the seal is compressed in the thickness direction, a lateral boundary is provided, while at the same time a contact area which is present in the thickness direction is defined, in order to prevent the circuit board plug connector being pressed too far into the circuit board.

In other words, the collar forms a flat stop which at the same time defines the insertion depth of the press-in elements into the circuit board. Furthermore, visual monitoring can also be achieved in this way such that, when the circuit board plug connector is completely pressed into the circuit board, the collar which surrounds the contacts and press-in elements has to rest fully on the circuit board. If, for example, a gap can still be identified on one side, it would be clear to the observer that the circuit board plug connector is only incompletely pressed in.

In a further advantageous embodiment, the circuit board plug connector is inserted into corresponding press-in openings in a circuit board by way of its press-in elements and the signal contacts are connected to at least one LED (light-emitting diode) which is covered by a lens on the circuit board.

This embodiment provides a particularly efficient and sealed solution for a circuit board plug connector in which a sealed light-emitting diode is already integrated.

It is particularly advantageous when the signal contacts project through the circuit board into the region of the lens.

As an alternative, a plurality of LEDs can also be arranged in the lens, as a result of which a lighting arrangement which can be inserted is provided, a sealed circuit board plug connector being integrated in said lighting arrangement.

Therefore, an LED lighting apparatus which has a sealed circuit board interface is also provided according to the invention.

In particular, an LED lighting apparatus which has a sealed circuit board interface according to one of the above-mentioned features individually or in combination is therefore provided according to the invention.

BRIEF DESCRIPTION OF THE FIGURES

Further advantages, features and embodiments of the present invention can be gathered from the following description of the figures, the patent claims and the figures, in which:

In the figures, identical or identically acting components are identified by the same reference symbols.

DETAILED DESCRIPTION OF THE INVENTION

Figure 1:
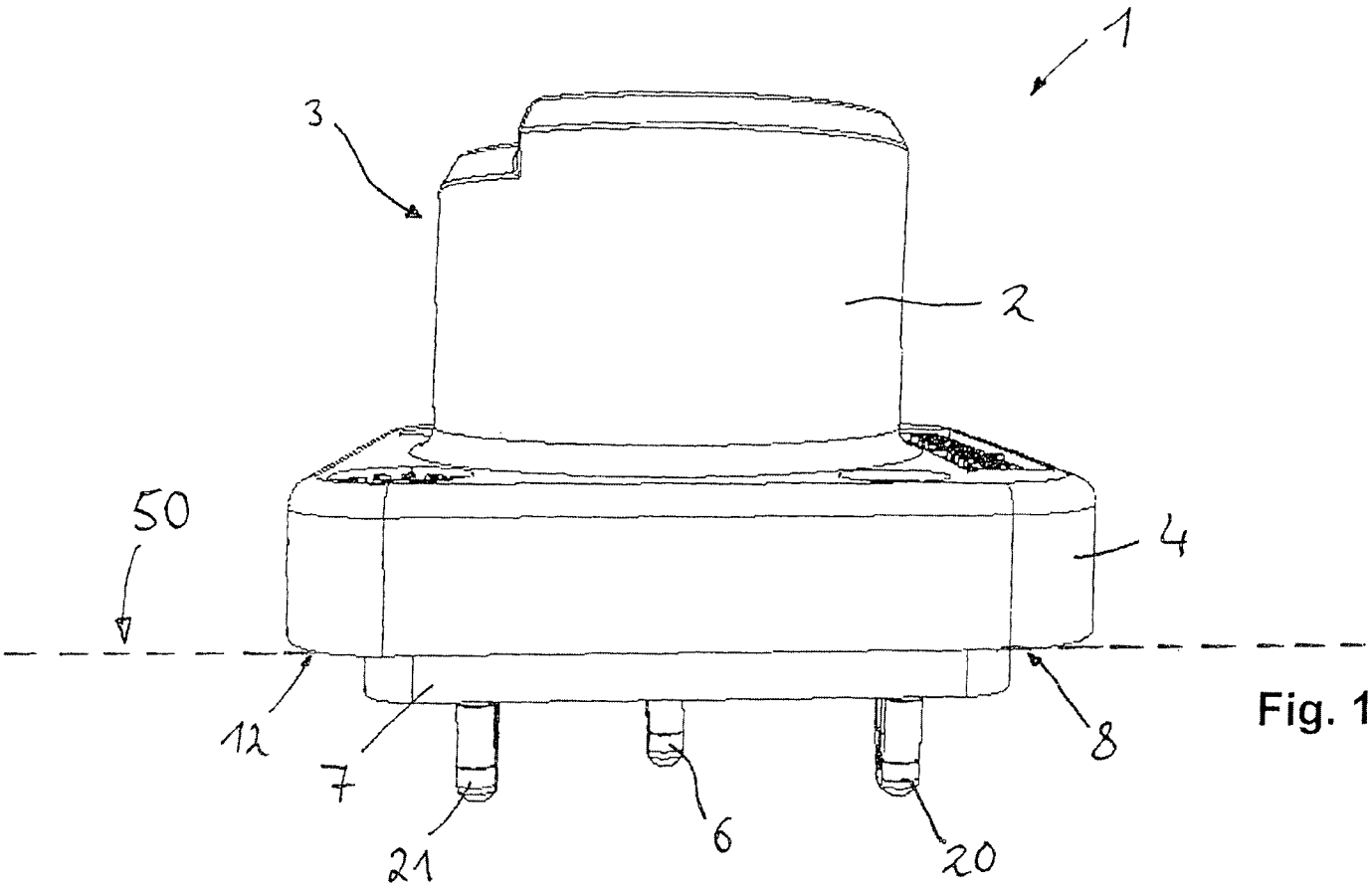
FIG. 1 shows a perspective view of a circuit board plug connector according to the invention.

FIG. 1 shows an exemplary embodiment of a circuit board plug connector 1 according to the invention. The circuit board plug connector 1 comprises an interface housing 2 which, in the present exemplary embodiment, has a receiving socket 3 with a receiving space 5. A corresponding mating plug can make electrical and mechanical contact with the circuit board plug connector 1 in the receiving socket 3 or in the receiving space 5.

Figure 2:
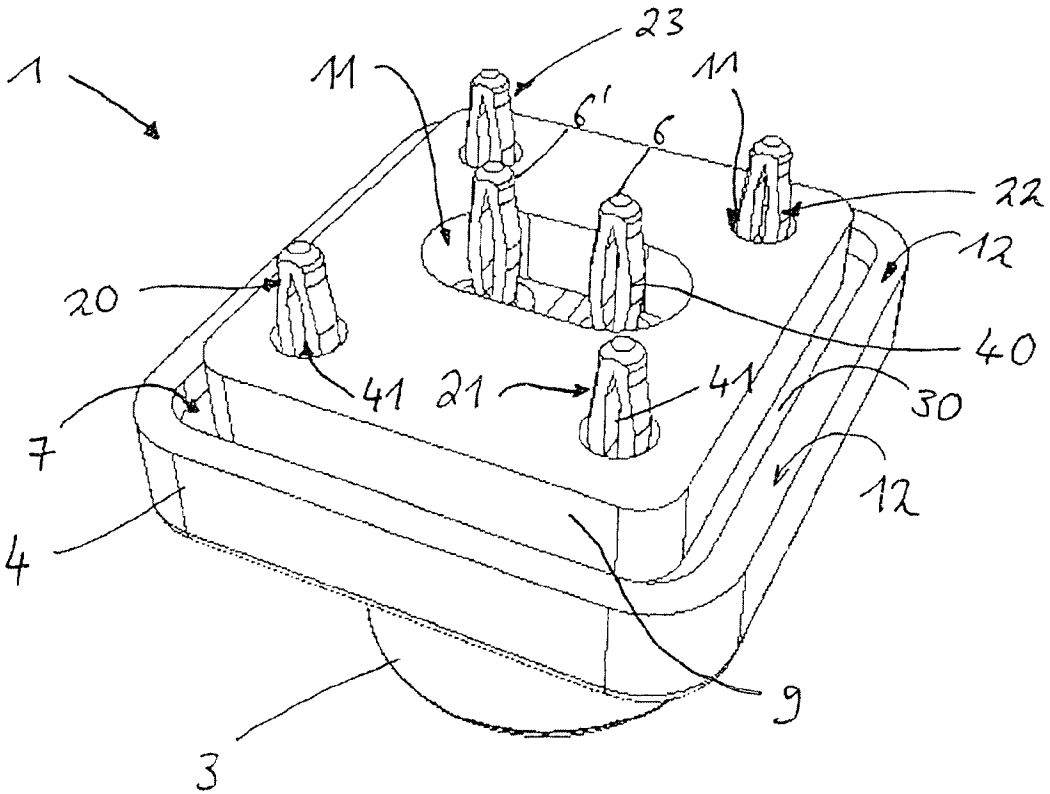
FIG. 2 shows a perspective view of a circuit board plug connector according to the invention in line with FIG. 1 obliquely from below.

As shown in FIG. 1 and FIG. 2, the circuit board plug connector 1 has two signal contacts 6, 6'. In the present exemplary embodiment, the signal contacts 6, 6' are in the form of press-in contacts with press-in zones 40.

FIG. 1 and FIG. 2 likewise show that in each case one mechanical connecting means is arranged adjacent to the corners of the substantially cuboidal circuit board plug connector flange 4 (called flange 4 for short).

In the present exemplary embodiment, the mechanical connecting means are in the form of press-in elements 20, 21, 22, 23 according to the invention. The press-in elements 20, 21, 22, 23 have press-in zones 41 in order to mechanically connect said press-in elements to the circuit board, as shown in FIG. 3.

Figure 3:
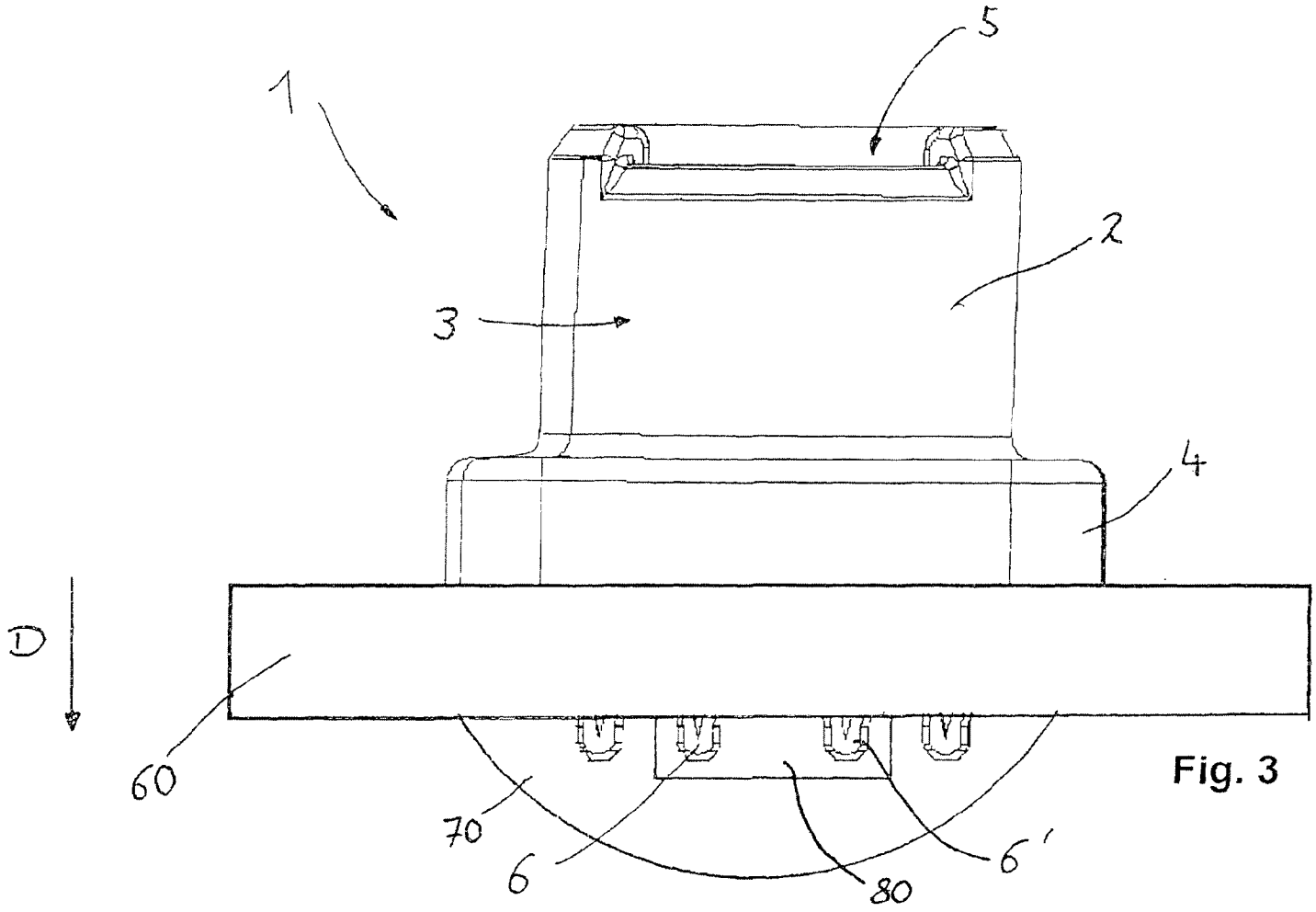
FIG. 3 shows a schematic sectional view through a sealed circuit board plug connector according to the invention which is connected to a circuit board on which an LED which is covered by a lens is arranged.

As shown in FIG. 3, the flange 4 and therefore the interface housing 2 has a recess 7 which forms a contact area 30. The contact area 30 is surrounded by a circumferential collar 12.

A seal 9 is inserted into the recess 7, said seal lying on the contact area 30 so as to form a gap in relation to the collar 12, as is shown by way of example in the perspective view in FIG. 2.

When the circuit board plug connector 1 is pressed into a circuit board 60, the seal 9 is compressed in thickness direction D and can expand into the gap which is shown in FIG. 2. The surface of the seal 9 forms the sealing plane with the surface of the circuit board 60. This sealing plane at the same time constitutes the mounting plane 50 of the circuit board plug connector 1.

As in the present exemplary embodiment, the mounting plane 50 is formed by the top face of the collar 12.

Furthermore, the press-in zones 40 and/or the press-in zones 41 of the signal contacts 6, 6' and of the press-in elements 20, 21, 22, 23 are at least partially located in the mounting plane 50.

The mounting state shown in FIG. 3 is achieved by virtue of the circuit board plug connector 1 being pressed into the circuit board 60 by way of the seal 9 in such a way that the collar 12 and therefore the mounting plane 50 come to rest on the top face of the circuit board.

In FIG. 1, the mounting plane 50 is shown by way of example by a dashed line.

Therefore, the stop of the collar 12 and the press-in zones 40, 41 both of the contacts and also of the press-in elements lie in a substantially common plane in the present exemplary embodiment.

The seal 9, not illustrated, has been compressed in thickness direction D in the exemplary view shown in FIG. 3.

Furthermore, FIG. 3 shows that the two signal contacts 6, 6' make electrical contact with an LED 80 (light-emitting diode), wherein the LED 80 is covered in a sealed manner by a lens 70.

This provides an LED lighting apparatus which has a sealed circuit board interface.

LIST OF REFERENCE SYMBOLS

1 Circuit board plug
2 Interface housing
3 Receiving socket
4 Flange
5 Receiving space
6, 6' Signal contacts
7 Recess
8 Sealing region
9 Seal
10 Connection region
11 Passage opening
12 Collar
20, 21, 22, 23 Press-in elements
30 Contact area
40 Press-in zones
41 Press-in zones
50 Mounting plane
60 Circuit board
70 Lens
80 LED
D Thickness direction

The invention claimed is:

1. A sealed circuit board plug for electrically connecting a plug to a circuit board, comprising:

a) an interface housing which has at least one signal contact in the connection region and which has at least two press-in elements with press-in zones;

b) the interface housing is designed with a contact area for a seal;

c) a seal which is arranged in the sealing region of the circuit board plug, wherein the seal has a passage opening for the at least one signal contact and has in each case one opening for the at least two press-in elements, wherein the circuit board plug is inserted into corresponding press-in openings of a circuit board by way of the at least two press-in elements and the at least one signal contact is connected to at least one LED which is covered by a lens on the circuit board.

2. The sealed circuit board plug as claimed in claim 1, wherein the at least one signal contact is in the form of a press-in contact.

3. The sealed circuit board plug as claimed in claim 1, wherein the circuit board plug has a receiving socket with a receiving space for receiving a corresponding mating plug on that side which is situated opposite the contact area, and the at least one signal contact projects into the receiving space by way of one of their ends.

4. The sealed circuit board plug as claimed in claim 3, wherein press-in zones of the at least one signal contact and the press-in zones of the at least two press-in elements are arranged in the same mounting plane.

5. The sealed circuit board plug as claimed in claim 1, wherein the seal is arranged at least partially in the region of the press-in zones in the thickness direction, and therefore the seal is compressed in the thickness direction when the circuit board plug is pressed into a circuit board.

6. The sealed circuit board plug as claimed in claim 1, wherein the sealing region has a recess for inserting the seal.

7. The sealed circuit board plug as claimed in claim 6, wherein the recess is completely bounded by a collar which surrounds the at least one signal contact and the at least two press-in elements.

8. The sealed circuit board plug as claimed in claim 1, wherein the at least one signal contact projects through the circuit board into the region of the lens.

9. The sealed circuit board plug as claimed in claim 1, wherein the at least one signal contact is produced from a first material, and the at least two press-in elements are produced from a second material which is different from said first material.

* * * * *